US006416287B1

(12) United States Patent
Staab et al.

(10) Patent No.: US 6,416,287 B1
(45) Date of Patent: Jul. 9, 2002

(54) IMPELLER

(75) Inventors: Matthias Staab, Eisfeldstraase 27, 36211 Alheim; Rolf Reinhardt, Am Wäldchen 4e, 36199 Rotenburg, both of (DE)

(73) Assignees: Matthias Staab; Rolf Reinhardt, both of (DE)

( * ) Notice: Subject to any disclaimer, the term of this patent is extended or adjusted under 35 U.S.C. 154(b) by 0 days.

(21) Appl. No.: 09/491,660

(22) Filed: Jan. 27, 2000

(30) Foreign Application Priority Data

Jan. 29, 1999 (DE) ..... 199 03 397

(51) Int. Cl.[7] ..... F04D 5/00

(52) U.S. Cl. ..... 416/212 R; 416/204 R; 416/208; 416/213 A; 416/244 R; 415/55.1

(58) Field of Search ..... 415/55.1, 55.2, 415/55.3, 55.4, 55.5, 55.6, 55.7; 416/204 R, 207, 208, 212 R, 213 A, 214 R, 244 R

(56) References Cited

U.S. PATENT DOCUMENTS

| | | | | | |
|---|---|---|---|---|---|
| 2,911,189 | A | | 11/1959 | Von Ohain | |
| 3,429,700 | A | * | 2/1969 | Wiegand et al. | 416/212 R |
| 4,157,225 | A | * | 6/1979 | Levine | 416/244 R |
| 4,408,952 | A | * | 10/1983 | Schweinfurter | 415/55.6 |
| 4,477,228 | A | * | 10/1984 | Duffy et al. | 416/244 R |
| 5,409,357 | A | * | 4/1995 | Yu et al. | 415/55.1 |

FOREIGN PATENT DOCUMENTS

| | | | | | |
|---|---|---|---|---|---|
| DE | 1428246 | | | 1/1969 | |
| DE | 3406877 | A1 | * | 7/1984 | 416/208 |
| DE | 19716086 | A1 | | 10/1998 | |
| FR | 913659 | A | * | 9/1946 | 416/212 R |
| JP | 58-13188 | A | * | 1/1983 | 415/55.6 |
| JP | 59-595 | A | * | 1/1984 | 416/204 R |
| SU | 0234150 | A | * | 5/1969 | 415/55.7 |
| SU | 0199663 | A | * | 11/1969 | 415/55.1 |

* cited by examiner

*Primary Examiner*—Christopher Verdier
(74) *Attorney, Agent, or Firm*—Mayer, Brown, Rowe & Maw

(57) ABSTRACT

An impeller for a feed pump designed, in particular, as a side channel pump or as a peripheral pump has two disk parts connected fixedly in terms of rotation to one another. The disk parts can be manufactured in simply constructed molds, for example by the injection molding method, and can be provided with virtually any desired geometries of guide vanes. The impeller has high stability due to the rotationally fixed connection between the disk parts.

5 Claims, 3 Drawing Sheets

IMPELLER

FIELD OF THE INVENTION

The invention relates to an impeller for a feed pump designed, in particular, as a side channel pump or as a peripheral pump. This impeller has, in each of its end faces, a ring of guide vanes delimiting vane chambers and possesses a driver for fastening said impeller fixedly in terms of rotation to a correspondingly designed drive.

BACKGROUND OF THE INVENTION

Such impellers have, usually at their center, a nonround recess as a driver and can be slipped onto a shaft of an electric motor, the impellers being mounted with axial play on said shaft. As a rule, the impellers are manufactured from plastic by the injection molding method or are sintered. The feed pump provided with such an impeller is often used as a fuel pump in present-day motor vehicles. In order to achieve as high an efficiency as possible and low noise emissions with the feed pump, the guide vanes usually have a very high angle of inclination to the perpendicular on the end faces of the impeller. Moreover, in the case of impellers with axial throughflow, vane chambers located opposite one another are connected to one another. One disadvantage of the known impeller is that it is very complicated to remove it from the mold. In this case, an injection mold, a stamping mold or a compression mold has to be drawn apart during a rotational movement. Furthermore, the impeller requires a core for the driver, since the latter is usually oriented perpendicularly to the end faces of the impeller. The result of this is that the manufacture of the impeller is highly cost-intensive.

There has already been the idea of composing the impeller of two disk parts and, for example, of arranging a ring of guide vanes in each of the disk parts. The disk parts each have a driver, by means of which they are slipped onto the shaft of the electric motor. As a result, in the mounted state, the disk parts are pressed against one another by the pressure within the vane chambers. A disadvantage of this, however, is that the driver has tolerances, so that the disk parts can be aligned relative to one another only with a great degree of inaccuracy. Furthermore, the internal pressure in the vane chambers is often not sufficient to press the disk parts reliably against one another. The result of this is that the feed pump has very low efficiency.

The problem on which the invention is based is to design an impeller of the type initially mentioned, in such a way that it can be produced very cost-effectively and a feed pump provided with it has particularly high efficiency.

SUMMARY OF THE INVENTION

This problem is solved, according to the invention, in that the impeller is composed of at least two disk parts lying one above the other and in that the disk parts are connected fixedly in terms of rotation to one another.

By virtue of this design, the guide vanes can be configured with very high angles of inclination and with inclination directions opposite to one another on the two end faces and can be manufactured in a very simple way. This design of the angle of inclination leads to particularly low noise emissions. Since the disk parts are connected outside the center of the impeller, forces acting on the disk parts are reliably supported. The feed pump provided with the impeller according to the invention has very high efficiency because of the rotationally fixed design of the connection of the disk parts. The invention makes it possible to manufacture virtually any desired design of guide vanes and of connections between vane chambers located opposite one another.

In an advantageous refinement, the two disk parts are pressed onto a driver located at their center. The driver has an outer contour differing from the circular shape, preferably a square contour. Other contours, for example a toothed profile, are, however, also possible. Furthermore, the driver possesses a receptacle for the drive shaft of the electric motor. In the simplest instance, this receptacle is a bore which has a flattening at one point on its circumference. Since the driver is usually arranged in the center of the impeller, it is therefore not necessary for all the disk parts to be provided with a driver. In the simplest instance, each of the disk parts can be manufactured in a coreless two-part mold. The manufacture of the impeller thereby becomes highly cost-effective.

According to a further refinement of the invention, the disk parts can be connected to one another in a simpler way if they are connected fixedly in terms of rotation to one another outside the center of the impeller.

It is advantageous, at the same time, if one of the disk parts has a projecting collar and the disk part located opposite the collar has a recess for receiving said collar.

According to another advantageous development of the invention, when the disk parts are pressed together the vane chambers are aligned particularly reliably relative to one another if the disk parts have rotation prevention means engaging positively one into the other.

According to another advantageous development of the invention, the disk parts, when being pressed together, are aligned relative to one another, without additional rotation prevention means, if at least one of the disk parts has bores for pressing together with a stud connected fixedly in terms of rotation to the other disk part.

The impeller according to the invention consists of particularly few components if the studs are formed in one piece with one of the disk parts.

According to another advantageous development of the invention, the disk parts can be designed identically if the studs are arranged in bores. This design results in a pronounced reduction in the costs of the dies necessary for producing the impeller according to tire invention. For example, two or more straight pins or dowel pins are suitable for reliable pressing together.

The impeller according to the invention has an intended height, irrespective of the pressures prevailing in the impeller, if the disk parts are adhesively bonded or welded to one another. This design likewise results in particularly high efficiency of the feed pump provided with the impeller according to the invention. Adhesive bonding or welding may be employed alone or in addition to the positive connection of the disk parts. For example, the number of pins necessary for pressing together can be kept low by means of points of adhesion. The disk parts can thereby also be manufactured as identical components. The welding method used could be, for example, reflector welding. However, the impeller requires only particularly little reworking if the welding method used is ultrasonic welding.

A contribution to further simplifying the assembly of the impeller according to the invention is made if one of the disk parts has catch recesses and if the other disk part has catch hooks penetrating into the catch recesses.

According to another advantageous development of the invention, the disk parts are reliably prestressed relative to one another if the disk parts have a bayonet fastening for connecting them.

The invention permits numerous embodiments. In order to make its basic principle even clearer, several of these are illustrated in the drawings and are described below.

In the drawings:

DETAILED DESCRIPTION OF THE PREFERRED EMBODIMENT

Figure 1:
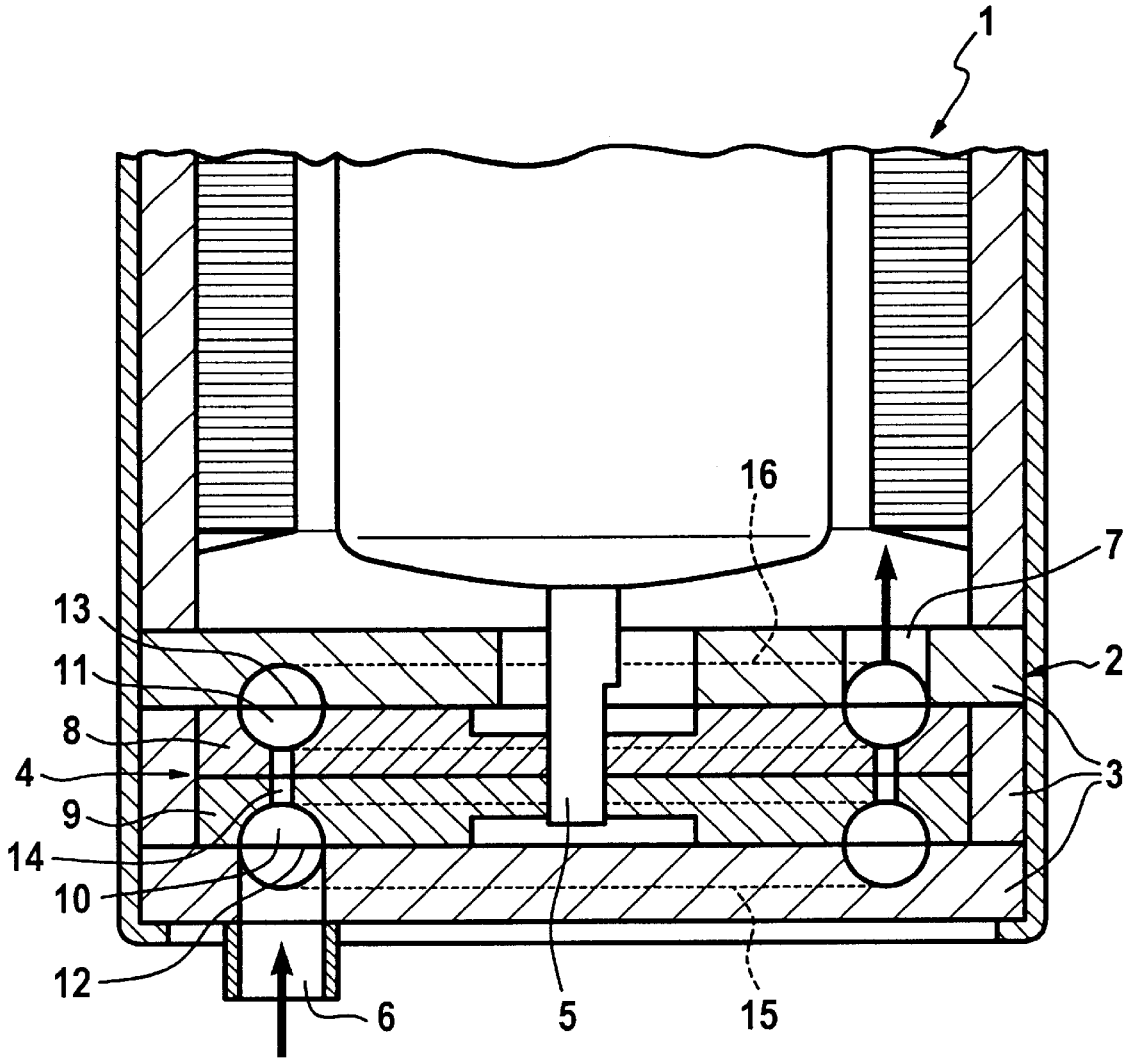
FIG. 1 shows a longitudinal section through a feed pump having an impeller according to the invention.

FIG. 1 shows, in longitudinal section, a feed pump 2 which is driven by an electric motor 1 (not shown) and is designed as an axial through-flow side channel pump. The feed pump 2 has an impeller 4 arranged rotatably in a casing 3 and fastened to a shaft 5 of the electric motor 1. The casing 3 has an inlet channel 6 on one side and an outlet channel 7 on the side located opposite the inlet channel 6. The impeller 4 is composed of two disk parts 8, 9 connected to one another in a materially integral manner. The materially integral connection of the disk parts 8, 9 may be made, for example, by adhesive bonding or welding, for example by the ultrasonic method. The disk parts 8, 9 each have a ring of guide vanes 12, 13 delimiting vane chambers 10, 11. Vane chambers 10, 11 located opposite on another are in each case connected to one another via a channel 14. The casing 3, in its regions located opposite the guide vanes 12, 13 of the disk parts 8, 9, has in each case a part-annular channel 15, 16 extending from level with the inlet channel 6 to level with the outlet channel 7, as seen in the direction of rotation of the impeller 4. The vane chambers 10, 11 and the part-annular channels 15, 16 form a feed chamber for a liquid to be fed.

By virtue of the two-part design of the impeller 4, the guide vanes 12, 13 can be manufactured with virtually any desired angle of inclination to the perpendicular of the end face of the impeller in a simply constructed mold, not illustrated, by the injection molding method, for example. In this case, the channels 14 for connecting the vane chambers 10, 11 located opposite one another may have an angle differing from the angle of inclination of the guide vanes 12, 13 and be oriented, for example, perpendicularly to the end face of the impeller 4. The impeller 4 may, of course, also have three or more disk parts connected to one another. It would thereby be possible for the guide vanes 12, 13 and channels 14 to be produced with other geometries.

Figure 2:
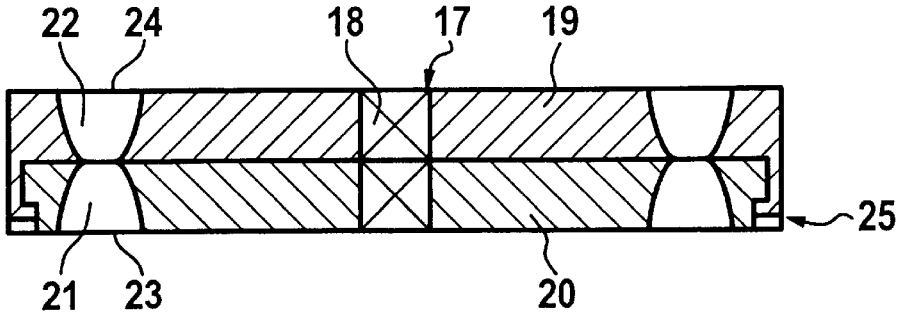
FIG. 2 shows a further embodiment of the impeller according to the invention.

FIG. 2 shows a longitudinal section through a further embodiment of the impeller according to the invention. The impeller has, at its center, a driver 17 with a square piece 18, by means of which it can be arranged fixedly in terms of rotation on a correspondingly designed drive, not illustrated. The impeller has two disk parts 19, 20 and, in each of its end faces, a ring of guide vanes 23, 24 delimiting vane chamber 21,22. Vane chambers 21,22 located opposite one another overlap, so that a medium to be fed can flow from one vane chamber 21 over into the other vane chamber 22. Instead of the driver 17, the disk parts 19, 20 may be connected to one another via a bayonet fastening 25 which simultaneously serves as a rotation prevention means.

Figure 3:
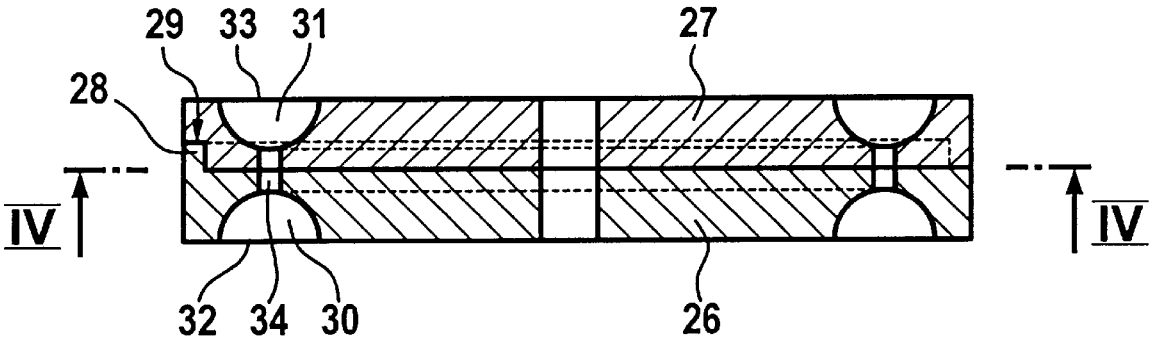
FIG. 3 shows an impeller according to the invention having disk parts pressed together with one another.

FIG. 3 shows a further embodiment of the impeller according to the invention, in which two disk parts 26, 27 are pressed together with one another. For this purpose, one of the disk parts 26 has a projecting collar 28 and the other disk part 27 has a recess 29 for receiving the collar 28. The collar 28 is arranged outside guide vanes 32, 33 delimiting vane chambers 30, 31. As in the case of the impeller from FIG. 1, vane chambers 30, 31 located opposite one another are connected to one another via channels 34.

Figure 4:
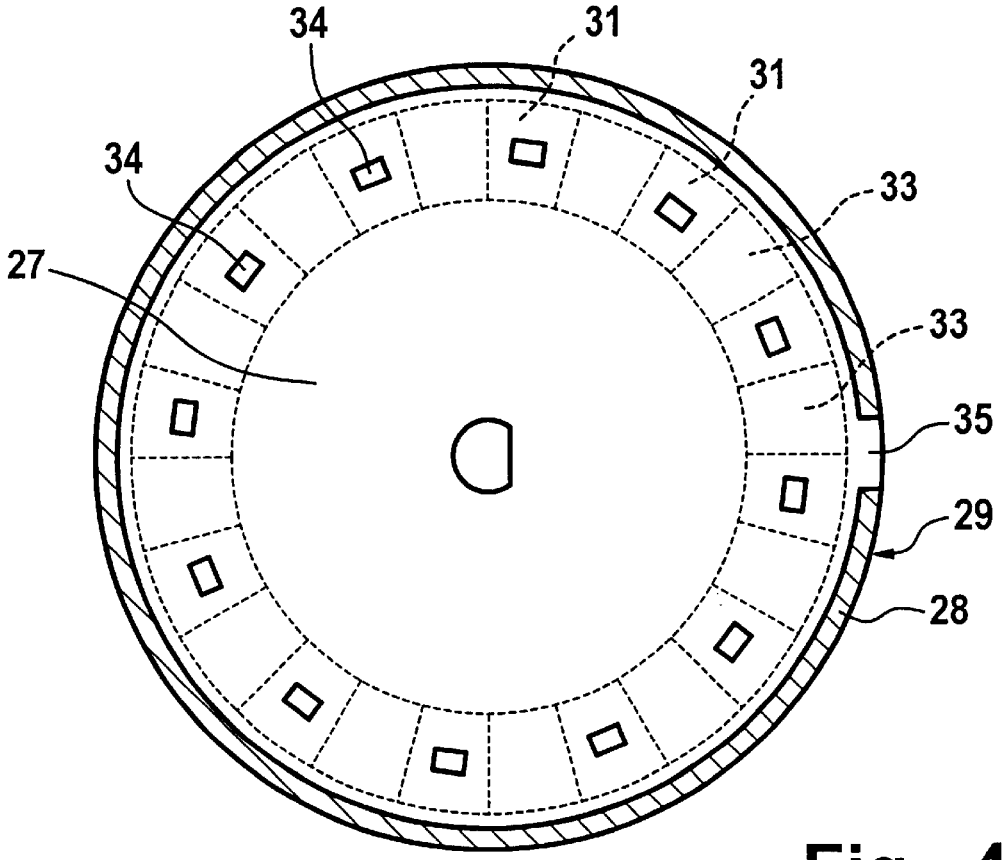
FIG. 4 shows a sectional illustration through the impeller from FIG. 3 along the line IV—IV.

FIG. 4 shows, in a sectional illustration through the impeller from FIG. 3 along the line IV—IV, that the disk part 27 having the recess 29 has a nose 35 pointing radially outwards into the recess 29 and is clamped between ends of the collar 28 of the disk part 26 illustrated in FIG. 3. The disk parts 26, 27 are thereby connected fixedly in terms of rotation in an intended position relative to one another.

Figure 5:
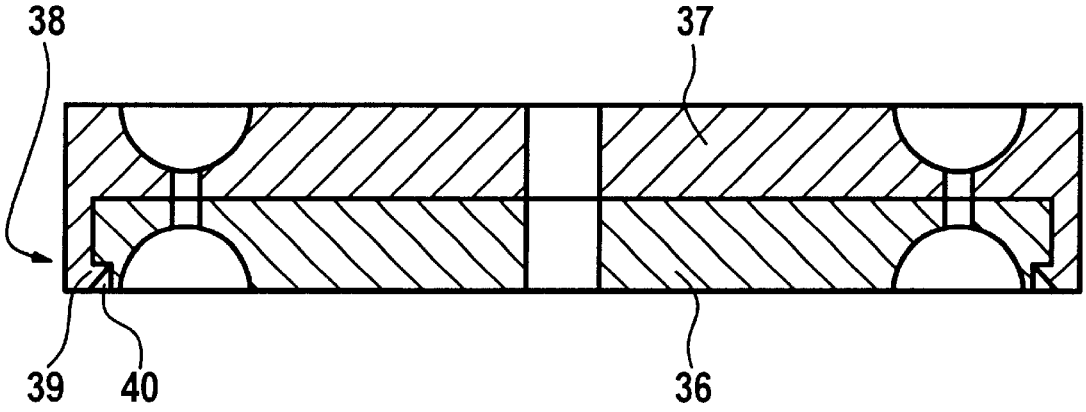
FIGS. 5 and 6 show further embodiments of the impeller according to the invention.

FIG. 5 shows a further embodiment of the impeller according to the invention, in which disk parts 36, 37 located opposite one another are connected to one another by means of a catch connection 38. For this purpose, one of the disk parts 37 has projecting catch hooks 39 which are designed to be elastic in the radial direction of the impeller and penetrate into catch recesses 40 of the other disk part 36.

Figure 6:
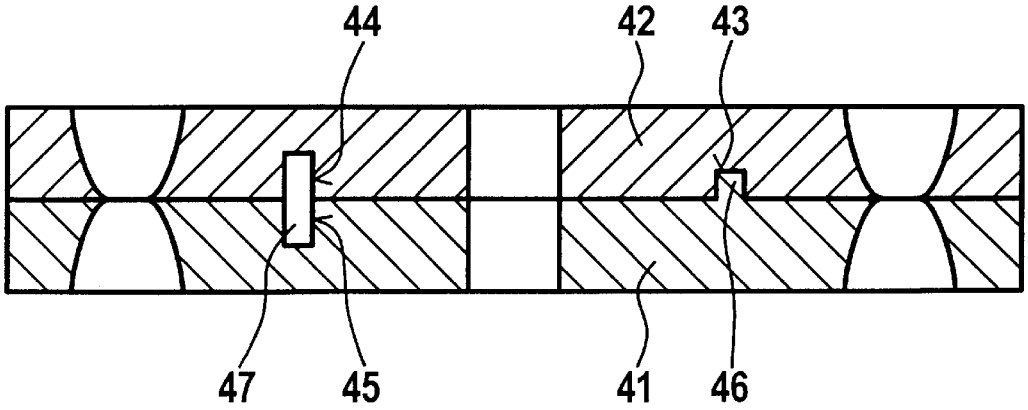

FIG. 6 shows a further embodiment of the impeller according to the invention, in which two disk parts 41, 42 have bores 43–45 for pressing them together. One of the disk parts 41 is manufactured in one piece with a stud 46. A pin 47 penetrates into bores 44, 45, located opposite one another, in the disk parts 41, 42. The disk parts 41, 42 may, of course, also either have solely the bores 44, 45 for the pins 47 to be inserted separately or have studs 46 manufactured in one piece with one of the disk parts 41.

What is claimed is:

1. An impeller for a feed pump comprising:

a center;

at least one end face;

a ring of guide vanes delimiting vane chambers in the end face;

a driver for fastening said impeller fixedly in terms of rotation to a correspondingly designed drive;

a first disk part lying above a second disk part, wherein the two disk parts are connected fixedly in terms of rotation to one another; and wherein the second disk part has catch recesses and the first disk part has catch hooks penetrating into the catch recesses of the first disk part.

2. The impeller as claimed in claim 1 wherein the two disk parts are connected fixedly in terms of rotation to one another outside the center.

3. The impeller as claimed in claim 1, wherein the disk parts comprise a disk center and are pressed onto the driver arranged at their disk center.

4. The impeller as claimed in claim 3, wherein the driver possesses a non-circular outer contour.

5. The impeller as claimed in claim 4, wherein the outer contour is a square.

* * * * *